US006811412B2

(12) United States Patent
Uezono

(10) Patent No.: US 6,811,412 B2
(45) Date of Patent: Nov. 2, 2004

(54) SEPARABLE STRUCTURED ELECTRIC CONNECTION BOX

(75) Inventor: Koichi Uezono, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/618,589

(22) Filed: Jul. 15, 2003

(65) Prior Publication Data

US 2004/0029419 A1 Feb. 12, 2004

(30) Foreign Application Priority Data

Aug. 8, 2002 (JP) ..... 2002-231250

(51) Int. Cl.[7] ..... H01R 12/00

(52) U.S. Cl. ..... 439/76.2; 439/638; 439/949; 439/709

(58) Field of Search ..... 439/76.1, 76.2, 439/949, 34, 638, 701, 709, 712

(56) References Cited

U.S. PATENT DOCUMENTS 4,429,943 A * 2/1984 Inoue ..... 439/721
4,923,411 A * 5/1990 Hayashi et al. ..... 439/540.1
5,735,713 A * 4/1998 Sugiura ..... 439/638
5,817,976 A * 10/1998 Yanase et al. ..... 174/52.1
5,928,004 A * 7/1999 Sumida et al. ..... 439/76.2
6,050,856 A * 4/2000 Sugiura ..... 439/621
6,322,376 B1 * 11/2001 Jetton ..... 439/76.2
6,443,748 B1 * 9/2002 Yuasa ..... 439/205
6,582,239 B2 * 6/2003 Ozawa ..... 439/76.2

FOREIGN PATENT DOCUMENTS

JP 8-279686 10/1996
JP 10-247451 9/1998

* cited by examiner

*Primary Examiner*—Alex Gilman
(74) *Attorney, Agent, or Firm*—Armstrong, Kratz, Quintos, Hanson & Brooks, LLP

(57) ABSTRACT

To reduce temperature rising of an electric connection box caused by high-current circuits, a separable structured electric connection box 1 includes at least two separated connection boxes 2, 3 having respectively a narrow width portion 8 or 10 and a wide width portion 9 or 11. The narrow width portion of one separated connection box and the wide width portion of the other separated connection box are combined. High-current bus bars 6, 7 are wired respectively at each outside wall 4 or 5 of separated connection boxes 2, 3. High-current fusible link mount portions 12, 13 are disposed along the high-current bus bar at the diagonally opposite narrow width portion of each separated connection box.

4 Claims, 3 Drawing Sheets

SEPARABLE STRUCTURED ELECTRIC CONNECTION BOX

BACKGROUND OF THE INVENTION

1. Field of the Invention

This invention relates to a separable structured electric connection box which can be separated to at least two separated connection boxes respectively having a high-current bus bar and a fusible link or the like connected with the high-current bus bar.

2. Description of the Related Art

A structure of an embodiment of a separable structured electric connection box by prior art proposed in Japan Patent Application Laid-open H10-247451 by an applicant of the present invention is shown in FIG. 5.

A separable structured electric connection box 51 includes a first separated connection box 56 having fusible links 52, 53 and a relay 54, and a second separated connection box 57 having a relay 55. Each separated connection box 56, 57 has a connection box body made of synthetic resin and respective housings for mounting fuses and relays in the connection box body. One high-current fusible link 52 and a plurality of fusible links 53 supplied electric power through the fusible link 52 are disposed. The relay 54 is connected through the fusible link 53. Respective fusible links 52, 53 are connected with each other through bus bars 67 of conductive metal plate.

A pair of terminals 58 of the fusible link 52 for power source is joined with a circular plate terminal 60 at an end of an electric wire 59 by a bolt 61 and a nut, as shown in FIG. 6. The pair of terminals 58 is continuous to a fusible body in a case 52*a*. The electric wire 59 is connected with the relay 55. The bolt 61 is screwed by an impact wrench (tool) 63.

Two separated connection boxes 56, 57 are combined by means of fitting by sliding or locking. By separating the electric connection box 51 into two blocks, each blocks can be easily molded with synthetic resin and more complicated structure of the electric connection box can be provided. The electric connection box 51 is fixed on a vehicle body by a bracket 64 disposed together with a connection box body.

A separable structured electric connection box by combining three separated connection box having an almost same size other than above-mentioned references is proposed in Japan Patent Application Laid-open H8-279686 by the applicant of the present invention.

Objects to be Solved

However, the aforesaid separable structured electric connection box by prior art has drawbacks that temperature of a specific area in the electric connection box is increased by concentrated heating around a bus bar and fusible links when bus bars continuous to a high-current fusible link are disposed in parallel and in proximity to each other or when high-current fusible links are disposed adjacently so that fusible links, low-current fuses and relays in the vicinity of the specific area may be affected. Furthermore, when a terminal of the fusible link is screwed with a bus bar by a tool, the separated connection box is handled difficultly and operatability for connection may be bad.

To overcome the above drawback of prior art, an object of this invention is to provide a separable structured electric connection box which can eliminate heating concentration by a high-current fusible link and bus bars continuous to the high-current fusible link and has good operatability of connecting the fusible link and bus bars.

SUMMARY OF THE INVENTION

How to Attain the Object

In order to attain the objects, a separable structured electric connection box according to the present invention includes at least two separated connection boxes having respectively a narrow width portion and a wide width portion, and the narrow width portion of one separated connection box and the wide width portion of the other separated connection box are combined and the wide width portion of one separated connection box and the narrow width portion of the other separated connection box are combined, and a high-current bus bar is wired respectively at an outside wall of each separated connection box, and a high-current fusible link mount portion is disposed along the high-current bus bar at the diagonally opposite narrow width portion of each separated connection box.

According to the above-mentioned structure, the narrow width portion of one separated connection box and the wide width portion of the other separated connection box are combined and the wide width portion of one separated connection box and the narrow width portion of the other separated connection box are combined. The high-current bus bar is wired respectively at an outside wall of each separated connection box so that heat releasing to outside from the high-current bus bar is efficient and the bus bars are prevented from heating. The high-current bus bars of each separated connection box are apart from each other so as to prevent heat influence of each other. Furthermore, the each high-current fusible link connected with each bus bar is disposed apart from each other at the diagonally opposite position of the electric connection box so as to prevent heat influence of each other. Thus, temperature rising (heating) of the electric connection box by high current is prevented.

The separable structured electric connection box mentioned above is more specified by that a pair of terminals of a high-current fusible link in the high-current fusible link mount portion is connected with an external terminal or the bus bar by being fastened with a screw from both of a combined wall and said outside wall of said narrow width portion.

According to the above-mentioned structure, the pair of terminals of the high-current fusible link can be connected in good operatability with the high-current bus bar or the external terminal by fastening with a screw from both of the combined wall and the outside wall of said narrow width portion. Furthermore, a space of terminal connecting side of the high-current fusible link in the narrow width portion can be miniaturized and a dead space in the electric connection box can be reduced.

The separable structured electric connection box mentioned above is more specified by that one combined wall of the narrow width portion of one of separated connection boxes and the other combined wall of the wide width portion of corresponding separated connection box are joined with each other.

According to the above-mentioned structure, a connecting terminal of the fusible link is joined between combined walls of the one separated connection box and the other separated connection box so that the connecting area is protected from rainwater penetration from outside or interference by outside.

The separable structured electric connection box mentioned above is more specified by that the respective high-current bus bars of the separated connection boxes are connected with each other by an electric wire.

According to the above-mentioned structure, the electric wire connecting the respective high-current bus bars with each other is exposed at outside or in the electric connection box so as to be cooled by air so that temperature rising (heating) of the electric connection box is prevented.

The above and other objects and features of this invention will become more apparent from the following description taken in conjunction with the accompanying drawings.

DESCRIPTION OF THE PREFERRED EMBODIMENT

Figure 1:
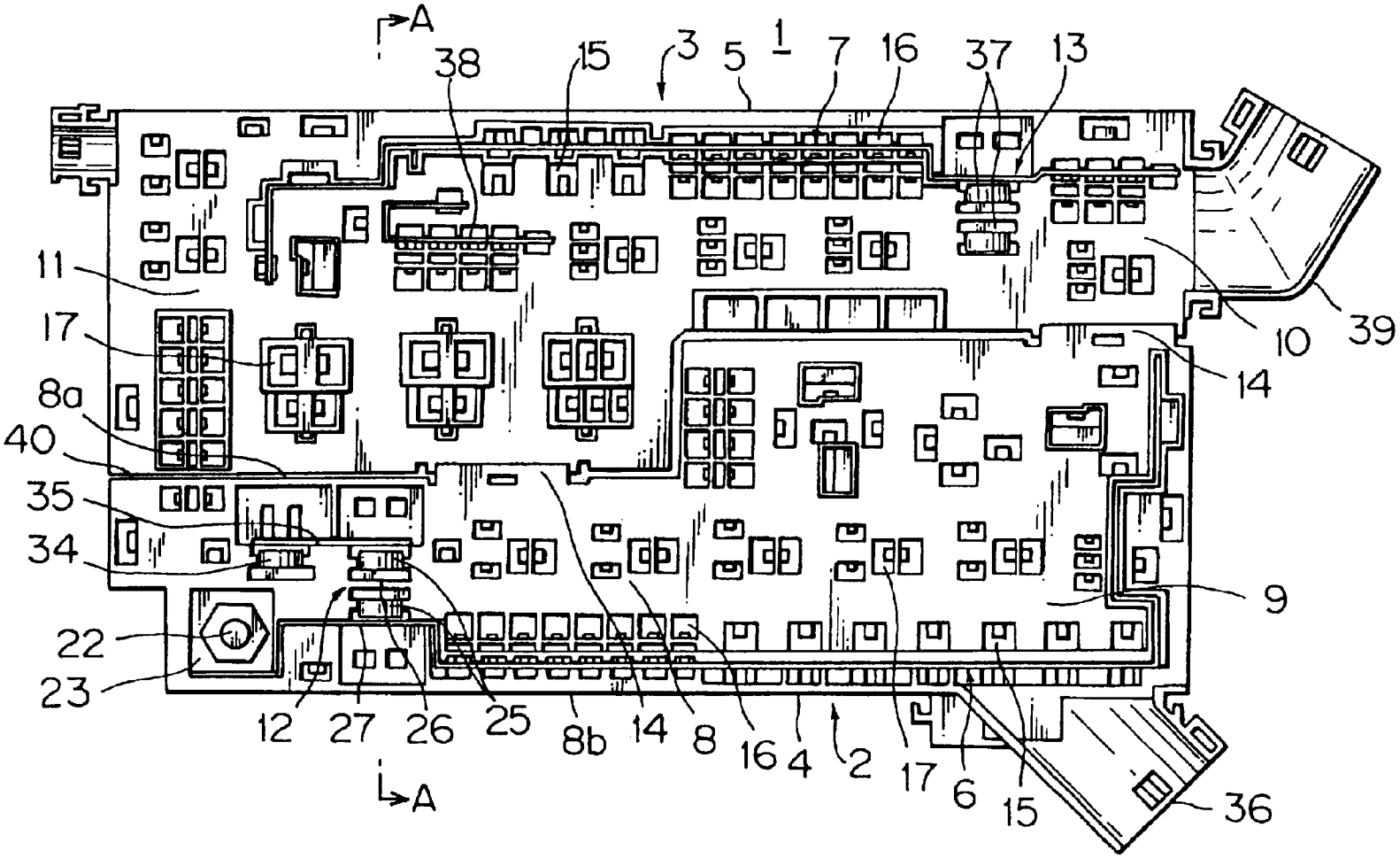
FIG. 1 is a bottom view of one embodiment of a separable structured electric connection box according to the present invention.
Figure 2:
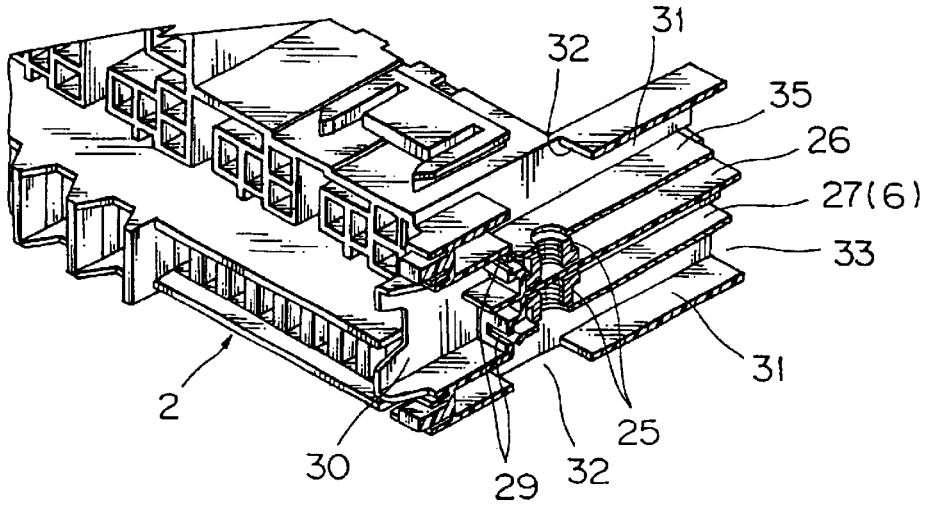
FIG. 2 is a sectional perspective view taking along the line A—A of the first separated connection box in FIG. 1.
Figure 3:
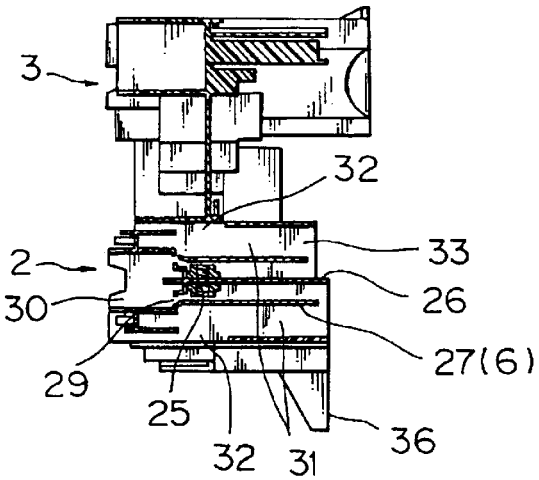
FIG. 3 is a sectional view taking along the line A—A of the combined first and second separated connection boxes in FIG. 1.

An embodiment according to the present invention will now be described with reference to drawings. FIGS. 1–3 show an embodiment of the separable structured electric connection box according to the present invention.

The separable structured electric connection box 1 is formed into a rectangular shape and separated by a crank-shape line at the center of the electric connection box 1 into a first separated connection box 2 and a second separated connection box 3 those have almost same size. Each high-current bus bar 6 or 7 is disposed respectively along an outer wall 4 or 5 of each separated connection box 2 or 3. Each high-current fusible link mount portion 12 or 13 connected with each high-current bus bar 6 or 7 is disposed at a narrow width portion (thin-wall portion) 8 or 10 of each separated connection box 2 or 3.

The narrow width portions 8, 10 and the wide width portions 9, 11 of each separated connection box 2, 3 are respectively disposed rotational symmetrically so as to join the narrow width portion 8 of the first separated connection box 2 and the wide width portion 11 of the second separated connection box 3 and join the wide width portion 9 of the first separated connection box 2 and the narrow width portion 10 of the second separated connection box 3. The both separated connection boxes 2, 3 are fixed at two positions of each set of the narrow width portion and the wide width portion by sliding vertically combining means 14 of a rail portion and guide portion and are locked by lock means (not shown) of a lock projection and an engaging step.

Each separated connection box 2 or 3 includes one high-current fusible link mount portion 12 or 13, a plurality of middle-current fusible link mount portions 15, a plurality of low-current fuse mount portions 16 and a plurality of relay mount portions 17. Each electric component mount portion 12, 13 or 15–17 is provided with a housing formed in the connection box body of synthetic resin and terminals (not shown) for connecting in the housing.

Figure 4:
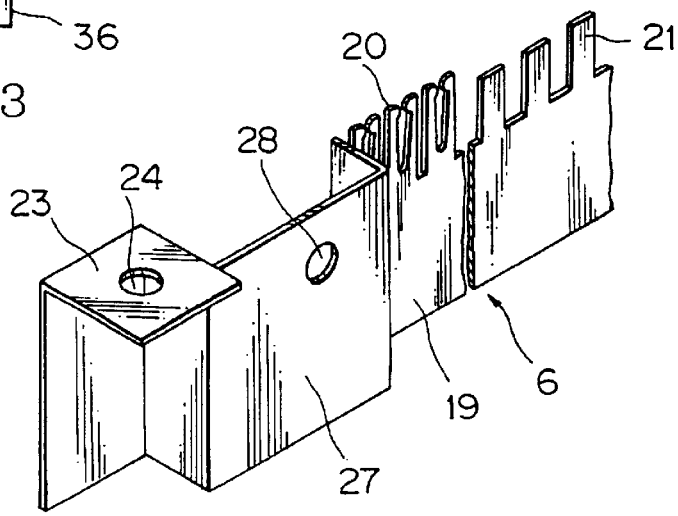
FIG. 4 is a perspective view of a main area of the high-current bus bar.
Figure 5:
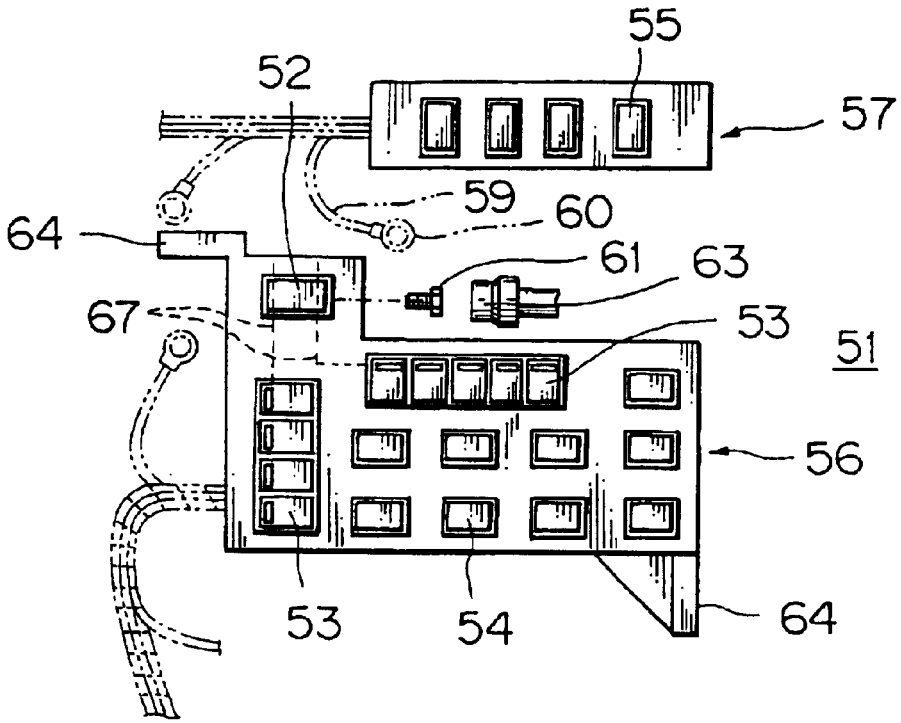
PRIOR ART FIG. 5
FIG. 5 is a plan view of a separable structured electric connection box by prior art.

In each separated connection box 2 or 3, the fuse mount portions 16 are disposed in parallel along lengthwise of the connection box adjacently to the high-current fusible link mount portion 12 or 13, and the middle-current fusible link mount portions 15 are disposed in parallel along lengthwise of the connection box adjacently to the fuse mount portion 16. The bus bar 6 or 7 is disposed along each electric component mount portion 16 or 15. The bus bar 6, as shown in FIG. 4, has U-shaped terminals 20 for connecting fuses and tab-type terminals 21 in parallel along lengthwise of a vertical plate 19.

In the first separated connection box 2 (FIG. 1), a stud bolt 22 is disposed adjacently to the high-current fusible link mount portion 12 in the vicinity of corner edge area of the narrow width portion 2, and the stud bolt 22 is fastened with a horizontal plate portion 23 (FIG. 4) of the bus bar 6 by a nut. The horizontal plate portion 23 has a hole 24 for inserting a bolt therethrough. The stud bolt 23 is connected with a not-shown circuit (thick electric wire) from a battery.

Two nuts 25 are disposed symmetrically against a partition wall 26 (insulating wall) at the high-current fusible link mount portion 12, and one (outer) nut 25 is fastened with a vertical plate portion 27 (FIGS. 2–4) of the high-current bus bar 6 by a bolt. The vertical plate portion 27 has a hole 28 for inserting the bolt therethrough (FIG. 4).

A pair of slit-shape openings 29 for inserting a plate-shape terminal (not shown) of the high-current fusible link therethrough is disposed adjacently to the vertical plate portion 27 and the other nut 25 at a bottom wall of the high-current fusible link mount portion 12 of the connection box, as shown in FIGS. 2, 3.

A cavity 30 (fitting section) of the fusible link mount portion 12 is disposed above the pair of nuts 25, and a space 31 for receiving an electric wire with a circular plate terminal under the pair of nuts 25. The space 31 is communicated to an opening 32 at an axial direction of the nuts 25 for fastening operation and an opening 33 for leading the electric wire. The bus bar 6 forms an inner wall of the space 31. The second separated connection box 3 has the same structure.

Figure 6:
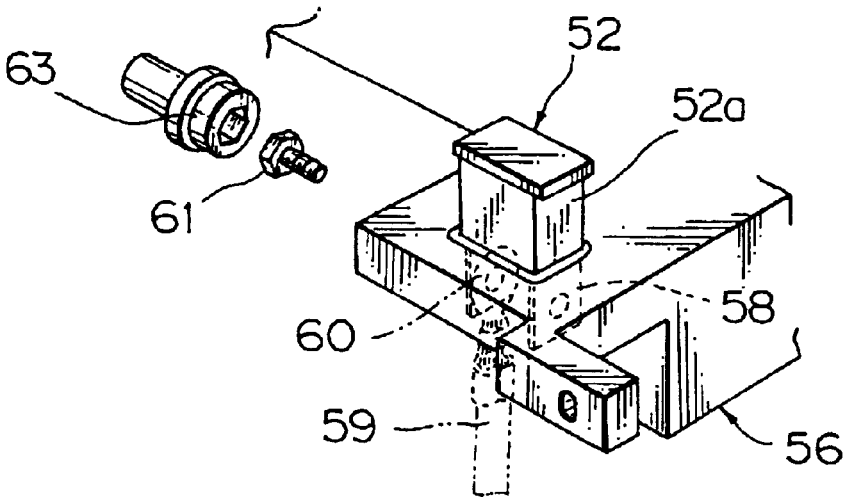
PRIOR ART FIG. 6
FIG. 6 is an exploded perspective view of connecting condition of a fusible link in the separable structured electric connection box by prior art.

A pair of terminals of the fusible link has a hole for inserting a bolt therethrough (FIG. 6). Each terminal is connected respectively with a circular plate terminal of each electric wire by respective bolt and nut 25. In a condition of separating the separated connection boxes 2 and 3, one circular plate terminal is mounted from the outside of the narrow width portion 8 (FIG. 1) and the other circular plate terminal is mounted from the inside of the narrow width portion 8. Thereafter, the circular plate terminals are fastened with a tool such as an impact wrench. The second separated connection box 3 is assembled similarly.

In the first separated connection box 2 (FIG. 1), the third nut 34 is disposed in parallel adjacently to the other nut 25. The other nut 25 and the third nut 34 are connected together by a short subsidiary bus bar 35. The subsidiary bus bar 35 is connected with the other circular plate terminal with an electric wire by the third nut 34 and a bolt.

The pair of one nut and the other nut 25 are disposed in the substantial center in a widthwise direction of the narrow width portion 8 and the axis of the nut (bolt) corresponds to the widthwise direction of the narrow width portion 8. Bus bars 6, 36, a fusible link or a circular plate terminal is fastened easily and securely on each nut 25 with an impact wrench from the both sides of the inner surface 8*a* and the outer surface 8*b*. The terminal of the fusible link or the circular plate terminal fastened on the nut 25 at the inner surface 8*a* is protected safely from rainwater or dust penetration from outside or interference by outside to be sealed by combining the both separated connection boxes 2, 3.

A long main bus bar 6 is formed into an L-shape along the outer wall 4 of the connection box body by bending. The long main bus bar 6 is connected with a middle-current fusible link at a long side from the narrow-width portion 8 to the wide-width portion 9 and a terminal of a fuse (not shown) at a short side of the wide-width portion 9. FIG. 1 is a bottom view of the electric connection box 1 and a fuse, a fusible link or a relay is mounted on a top side of each separated connection boxes 2, 3. The main bus bar 6 is held between the outer wall 4 and a thin insulating wall. A main bus bar in the second separated connection box 3 is held similarly. A half-cut cylindrical (semi-cylindrical) harness-lead-out portion 36 is formed at the short side of the wide-width portion 9.

In FIG. 1, a main bus bar 7 is disposed vertically along a long side of the outer wall 5 from an end of the narrow-width portion 10 of the second separated connection box 3. The end portion of the bus bar 7 is formed at a short side of the outer wall into an L-shape by bending. The bus bars 6, 7 of the both separated connection boxes 2, 3 are disposed substantially rotational symmetrically (diagonal-oppositely to each other) in the electric connection box. A pair of nuts 37 is disposed close to the end portion of the narrow-width portion 10. The bus bar 7, one terminal of the high-current fusible link and a circular plate terminal with an electric wire are fastened on one nut 37 by a bolt. The other terminal of the high-current fusible link and a circular plate terminal with an electric wire are fastened on the other nut 37 by a bolt. Small fuses, middle-current fusible links and relays are disposed along the bus bar 7 in a direction of lengthwise of the connection box and connected with the bus bar 7.

The bus bars 6, 7 of the both separated connection boxes 2, 3 are connected with each other by a thick electric wire (not shown). After combining the both separated connection boxes 2 and 3, the third nut 34 of the first separated connection box 2 and the nut 37 of the second separated connection box 3 are connected with an electric wire. The electric wire is exposed outside to radiate heat so that temperature rising in the electric connection box 1 is prevented. Each one terminal of the fusible links oppositely at a diagonal position of the electric connection box 1 is connected with an alternator by an electric wire having a circular plate terminal.

A short subsidiary bus bar 38 is disposed adjacently to the end portion of the main bus bar 7 in the second separated connection box 3. The subsidiary bus bar 38 is connected as a U-shape clamping terminal with respective one terminals of each low-current fuse. The main bus bar 7 and the subsidiary bus bar 38 are connected through the fuse. A half-cut cylindrical (semi-cylindrical) harness-lead-out portion 39 is formed at the short side of the narrow-width portion 10.

Middle-current fusible links, low-current fuses and relays in the both separated connection boxes 2 and 3 are connected by electric wires other than bus bars 6, 7, 35 and 38. Respective electric wires are bundled as wire harnesses which are led out through the harness-lead-out portions 36, 39. A cover (not shown) is mounted on the bottom side of the separated connection boxes 2, 3 so as to form cylindrical harness-lead-out portions by combining the half-cut cylindrical harness-lead-out portions of the cover and the harness-lead-out portions 36, 39. A small gap 40 is formed between the combined both separated connection boxes 2 and 3 for cooling bus bars 6, 7, 35 and connecting points of fusible links at the narrow-width portion by air through the gap 40.

The electric connection box 1 is designed as a separate type so that the wire harness can be easily separated to subsidiary portions. Connecting terminals for fusible links, fuses and relays are disposed respectively in each separated connection boxes and electric wires are wired for connecting with the terminals. Thereby, operatability of mounting terminals and wiring electric wires is enhanced and subsidiary wire harnesses in each separated connection boxes 2 and 3 are easily handled.

The high-current bus bars 6 and 7 are disposed along the outer walls 4, 5 of the respective separated connection boxes 2, 3 so that effectiveness of heat releasing by the bus bars 6, 7 is improved and temperature rising (heat generating) in the electric connection box 1 is reduced. The bus bars 6, 7 are disposed oppositely apart from each other so that effectiveness of heat releasing by the bus bars 6, 7 is more improved and temperature rising in the electric connection box 1 is more reduced. The high-current fusible links of the both separated connection boxes 2, 3 are disposed oppositely in diagonal position apart from each other so that temperature rising of the both fusible links is reduced. Therefore, influence by heating on fuses and relays at an area of bus bar and fusible links is improved so that reliability of electric connection in the electric connection box 1 is enhanced and the electric connection box 1 can be mounted at high temperature area such as an engine room.

The embodiment mentioned above shows the electric connection box 1 separated to two portions. However, the electric connection box can be separated to three or more portions. For example, the third and forth separated connection boxes can be combined on the short sides of the electric connection box 1 for improving more heat releasing. Not only circular plate terminal but also various shape terminals can be connected with the fusible links by nuts. Connectors other than relays, fuses and fusible links can be disposed in the electric connection box 1 for connecting with outer wire harness by the connector.

Having now fully described the invention, it will be apparent to one of ordinary skill in the art that many changes and modifications can be made thereto without departing from the scope of the invention as set forth herein

What is claimed is:

1. A separable structured electric connection box comprising at least two separated connection boxes having respectively a narrow width portion and a wide width portion, wherein said narrow width portion of one separated connection box and said wide width portion of the other separated connection box are combined and said wide width portion of one separated connection box and said narrow width portion of the other separated connection box are combined, whereby a high-current bus bar is wired respectively at an outside wall of each separated connection box, whereby a high-current fusible link mount portion is disposed along said high-current bus bar at the diagonally opposite narrow width portion of each separated connection box.

2. The separable structured electric connection box according to claim 1, wherein a pair of terminals of a high-current fusible link in said high-current fusible link mount portion is connected with an external terminal or said bus bar by being fastened with a screw from both of a combined wall and said outside wall of said narrow width portion.

3. The separable structured electric connection box according to claim 2, wherein one combined wall of said narrow width portion of one of separated connection boxes and the other combined wall of said wide width portion of corresponding separated connection box are joined with each other.

4. The separable structured electric connection box according to claim 1, 2 or 3, wherein said respective high-current bus bars of said separated connection boxes are connected by an electric wire with each other.

* * * * *